US010932591B2

(12) United States Patent
Hubbard

(10) Patent No.: US 10,932,591 B2
(45) Date of Patent: Mar. 2, 2021

(54) UTENSIL DISPENSER SYSTEM

(71) Applicant: Robert F. Hubbard, Wildwood, MO (US)

(72) Inventor: Robert F. Hubbard, Wildwood, MO (US)

( * ) Notice: Subject to any disclaimer, the term of this patent is extended or adjusted under 35 U.S.C. 154(b) by 338 days.

(21) Appl. No.: 16/094,143

(22) PCT Filed: May 18, 2018

(86) PCT No.: PCT/US2018/033485
§ 371 (c)(1),
(2) Date: Oct. 16, 2018

(87) PCT Pub. No.: WO2018/217581
PCT Pub. Date: Nov. 29, 2018

(65) Prior Publication Data

US 2021/0000267 A1 Jan. 7, 2021

Related U.S. Application Data

(60) Provisional application No. 62/509,388, filed on May 22, 2017, provisional application No. 62/581,130, filed on Nov. 3, 2017.

(51) Int. Cl.
*A47F 1/10* (2006.01)

(52) U.S. Cl.
CPC ..... *A47F 1/10* (2013.01); *A47F 2001/103* (2013.01)

(58) Field of Classification Search
None
See application file for complete search history.

(56) References Cited

U.S. PATENT DOCUMENTS

| | | | |
|---|---|---|---|
| 5,921,408 | A | 7/1999 | Groenewold et al. |
| 6,250,498 | B1 | 6/2001 | Lovejoy |
| 6,336,568 | B1 | 1/2002 | Tucker et al. |
| 6,763,972 | B2 | 7/2004 | Graupner |
| 6,832,694 | B2 | 12/2004 | Goeking et al. |
| 8,025,181 | B1 | 9/2011 | Horn |
| 8,070,013 | B2 | 12/2011 | Reinsel et al. |
| 8,152,004 | B2 | 4/2012 | Smith et al. |

(Continued)

FOREIGN PATENT DOCUMENTS

| | | |
|---|---|---|
| WO | 2001-05280 | 1/2001 |
| WO | WO2001005281 | 1/2001 |

(Continued)

*Primary Examiner* — Gene O Crawford
*Assistant Examiner* — Ayodeji T Ojofeitimi
(74) *Attorney, Agent, or Firm* — Spencer Fane LLP

(57) ABSTRACT

A utensil dispenser comprises a housing, a utensil support assembly and a utensil dispensing actuator. The utensil support assembly comprises a skewer for retaining a stack of utensils to be dispensed. The actuator provides for sequential dispensing of the utensils. The utensils are held in alignment on the skewer until they are sequentially dispensed. Dispensing occurs as the utensils are individually removed by the actuator from the skewer where the utensil falls by gravity to an opening at the bottom of the housing for presentation to a user. A retainer member keeps the utensils stored on the skewer until the utensil support assembly is mounted in the housing and the utensils are ready for dispensing.

18 Claims, 15 Drawing Sheets

(56) References Cited

U.S. PATENT DOCUMENTS

| | | | | |
|---|---|---|---|---|
| 8,210,364 | B2 | 7/2012 | Smith et al. | |
| 8,272,533 | B1 | 9/2012 | D'Amelia et al. | |
| 8,297,473 | B2 | 10/2012 | Smith | |
| 8,360,273 | B2 | 1/2013 | Reinsel et al. | |
| 8,701,932 | B2 | 4/2014 | Reinsel et al. | |
| 8,776,379 | B2 | 7/2014 | Walters | |
| 8,839,522 | B2 | 9/2014 | Walters | |
| 9,049,948 | B2 | 6/2015 | Jongen et al. | |
| 9,113,729 | B2 | 8/2015 | Righetti et al. | |
| 9,226,598 | B1 | 1/2016 | Knope | |
| 9,237,815 | B2 | 1/2016 | Smith | |
| 9,295,344 | B2 | 3/2016 | Reinsel et al. | |
| 9,332,861 | B2 | 5/2016 | Borke | |
| 9,345,340 | B2 | 5/2016 | Walters et al. | |
| 9,439,518 | B2 | 9/2016 | Oakes | |
| 9,560,920 | B2 | 2/2017 | Oakes | |
| 2005/0082307 | A1 | 4/2005 | Tucker | |
| 2007/0095717 | A1 | 4/2007 | Tucker | |
| 2008/0128445 | A1 | 6/2008 | Huand | |
| 2011/0296693 | A1 | 12/2011 | Oakes | |
| 2012/0080444 | A1 | 4/2012 | Smith et al. | |
| 2012/0145734 | A1 | 6/2012 | Walters | |
| 2012/0145735 | A1* | 6/2012 | Erickson | A47F 1/10 221/1 |
| 2015/0041484 | A1 | 2/2015 | Oakes | |
| 2015/0289679 | A1* | 10/2015 | Oakes | A47F 1/125 221/1 |
| 2016/0242569 | A1 | 8/2016 | Snyder et al. | |
| 2019/0029443 | A1* | 1/2019 | Smith | A47F 1/10 |
| 2019/0281996 | A1* | 9/2019 | Smith | A47G 21/00 |

FOREIGN PATENT DOCUMENTS

| | | |
|---|---|---|
| WO | 2004-028309 | 4/2004 |
| WO | WO2018017782 | 1/2018 |

* cited by examiner

UTENSIL DISPENSER SYSTEM

RELATED APPLICATIONS

The present patent application is related to and claims priority benefit to an earlier-filed provisional patent application titled UTENSIL DISPENSER SYSTEM, Ser. No. 62/509,388, filed May 22, 2017; and provisional patent application titled UTENSIL DISPENSER SYSTEM, Ser. No. 62/581,130, filed Nov. 3, 2017. The identified earlier-filed applications are hereby incorporated by reference into the present application as though fully set forth herein.

FIELD OF THE INVENTION

The present disclosed subject matter relates to a utensil dispenser system, more particularly to eating utensils mounted on a skewer and dispensed therefrom by movement of an actuator.

BACKGROUND OF THE INVENTION

Eating utensils, including forks, spoons, knives, and combination eating utensils, such as sporks, spifes, sporfs, knorks, etc. are tools used to eat. Such eating implements are provided to a user individually or dispensed from a bulk source. Dispensing eating utensils from a bulk source, such as a box or tray, invites unnecessary handling by multiple users resulting in uncleanliness and contamination of the dispenser and eating implements.

Individual wrapping or bulk dispensing of eating utensils avoids unnecessary handling and contamination. Current bulk dispensing technology involves cutlery dispensers having cabinetry with various molded plastic elements fitted together for dispensing utensils by movement of the various dispenser parts. The multitude of molded and fitted components exposes the current technology to damage and breakdown. While current technology may isolate bulk utensils from contamination prior to dispensing, users remain exposed to contamination of the dispenser and the utensils during retrieval of a utensil.

SUMMARY OF THE INVENTION

There is provided in the practice of the invention a utensil dispenser comprising a housing, a utensil support assembly and a utensil dispensing actuator. The utensil support assembly comprises a skewer for retaining a stack of utensils to be dispensed. The actuator provides for sequential dispensing of the utensils. The utensils are held in alignment on the skewer until they are sequentially dispensed. Dispensing occurs as the utensils are individually removed by the actuator from the skewer where the utensil falls by gravity to an opening at the bottom of the housing for presentation to a user. A retainer member keeps the utensils stored on the skewer until the utensil support assembly is mounted in the housing and the utensils are ready for dispensing.

In accordance with an embodiment of the invention, there is provided a housing for receiving a stack of utensils for sequential dispensing.

In accordance with another embodiment of the invention, there is provided a utensil support assembly comprising a skewer on which a plurality of utensils are provided which may be sequentially dispensed from the housing.

In accordance with yet another embodiment of the invention, there is provided a utensil support skewer having a configuration that retains an alignment of utensils stored thereon and permits rotation of the utensils about the skewer end for release therefrom.

In accordance with yet another embodiment of the invention, there is provided a utensil support skewer having a configuration that retains an alignment of utensils stored thereon and permits rotation of the utensils about the skewer end for release therefrom, and provides a retainer element for keeping the utensils stored on the skewer until the utensils are ready for dispensing.

These and other features of the present invention are described in greater detail below in the section titled DETAILED DESCRIPTION OF THE INVENTION.

BRIEF DESCRIPTION OF THE DRAWING FIGURES

The drawings constitute a part of this specification and include exemplary embodiments of the disclosed subject matter and illustrate various features thereof.

DETAILED DESCRIPTION OF THE INVENTION

Figure 1:
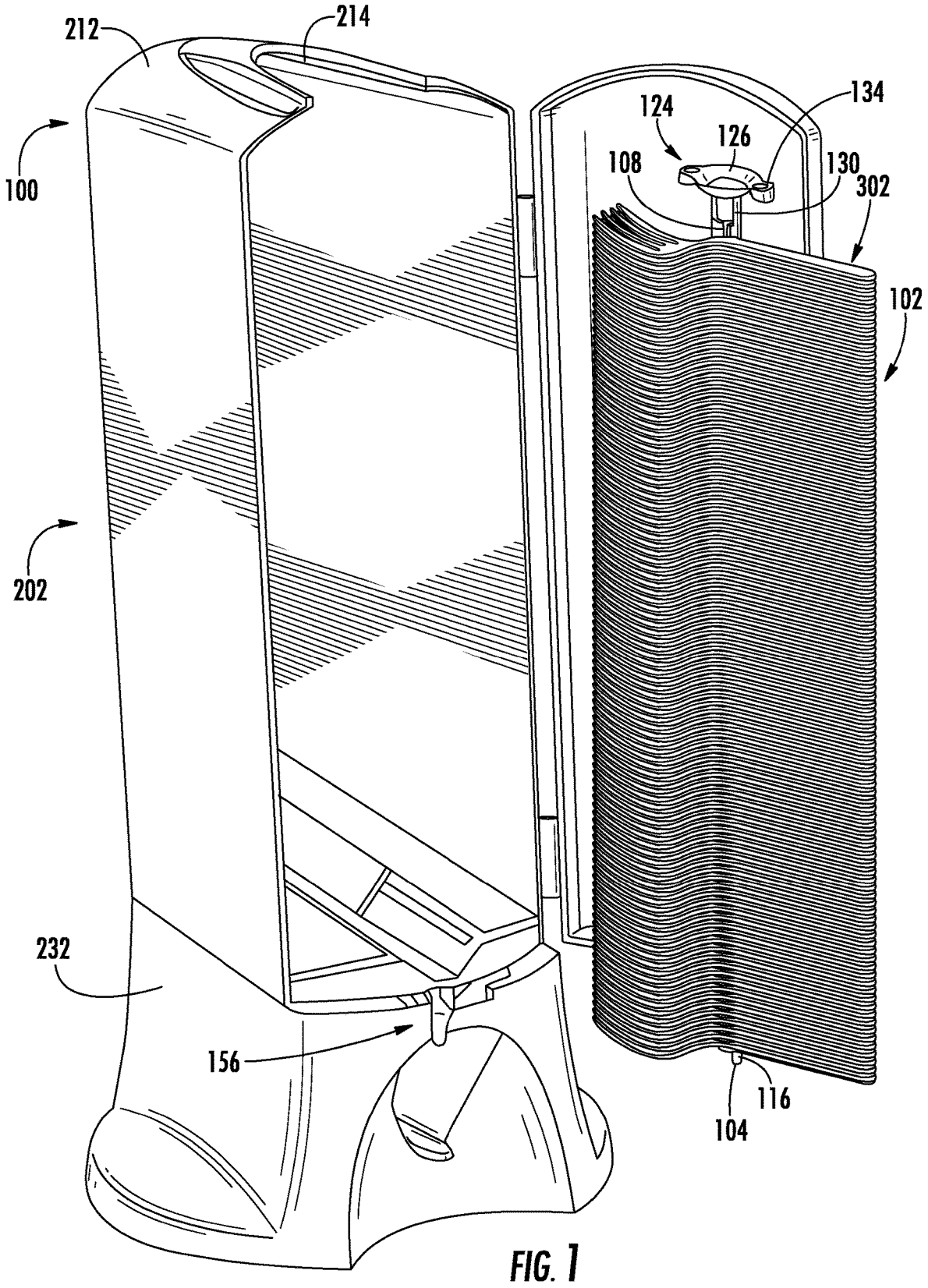
FIG. 1 is an isometric view of a utensil dispenser system with a utensil support assembly and utensil actuator embodying aspects of the disclosed subject matter.

With reference to the drawings figures, a utensil dispenser system is herein described, shown, and otherwise disclosed in accordance with various embodiments, including a preferred embodiment, of the present invention.

Referring to FIGS. 1-16 and the following detailed description, an embodiment of a utensil dispenser system 100 with a utensil support assembly 102 and utensil actuator 156 is shown and described. The utensil dispenser system 100 includes a housing 202 that dispenses one or more utensils 302, such as eating utensils, including spoons 352, knifes 354, and forks 356 from the utensil support assembly 102.

Figure 2:
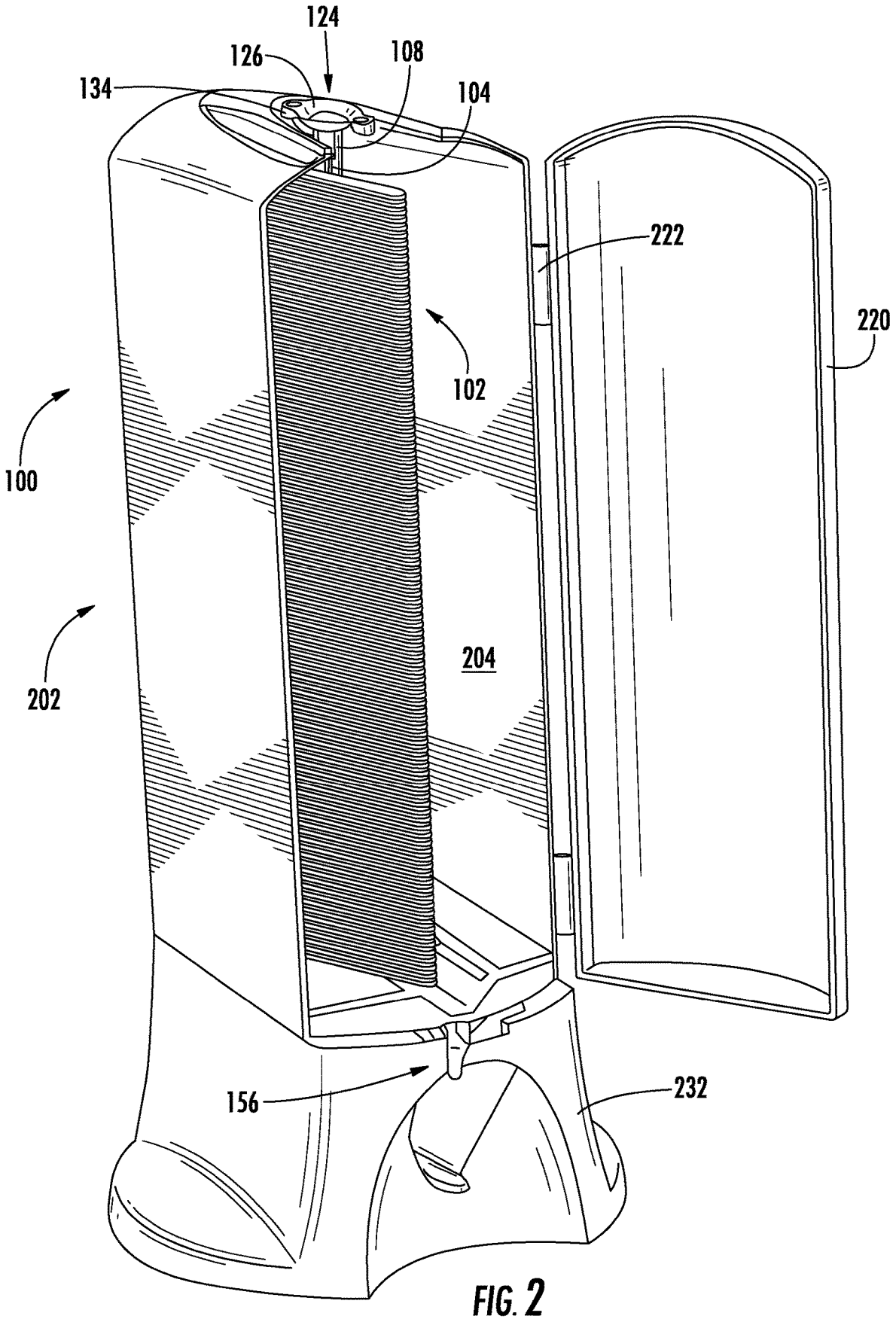
FIG. 2 is an isometric view of the utensil dispenser of FIG. 1 showing the utensil support assembly mounted in the cabinet housing.
Figure 4:
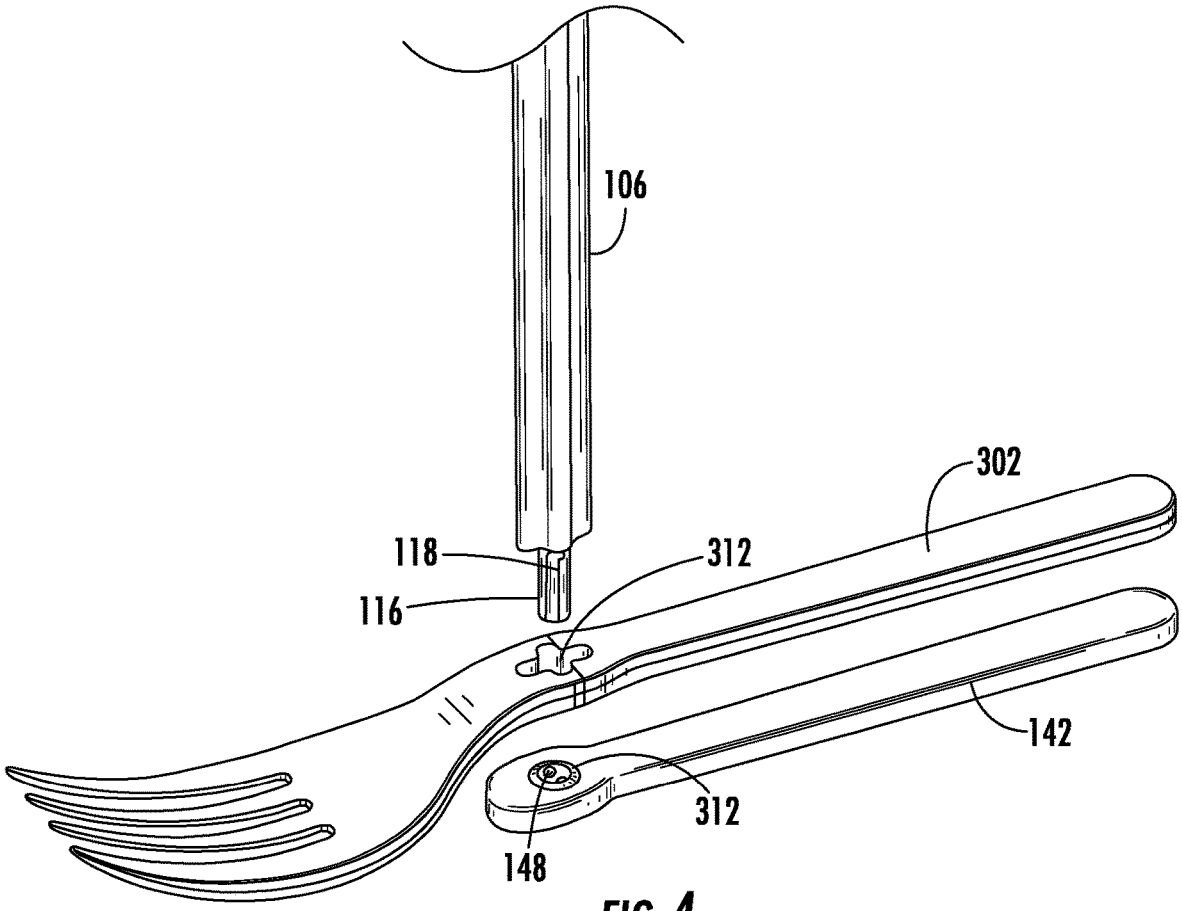
FIG. 4 is an exploded isometric view of an end of the skewer of the utensil support assembly embodying aspects of the disclosed subject matter showing alignment of a utensil and a retainer member.
Figure 5:
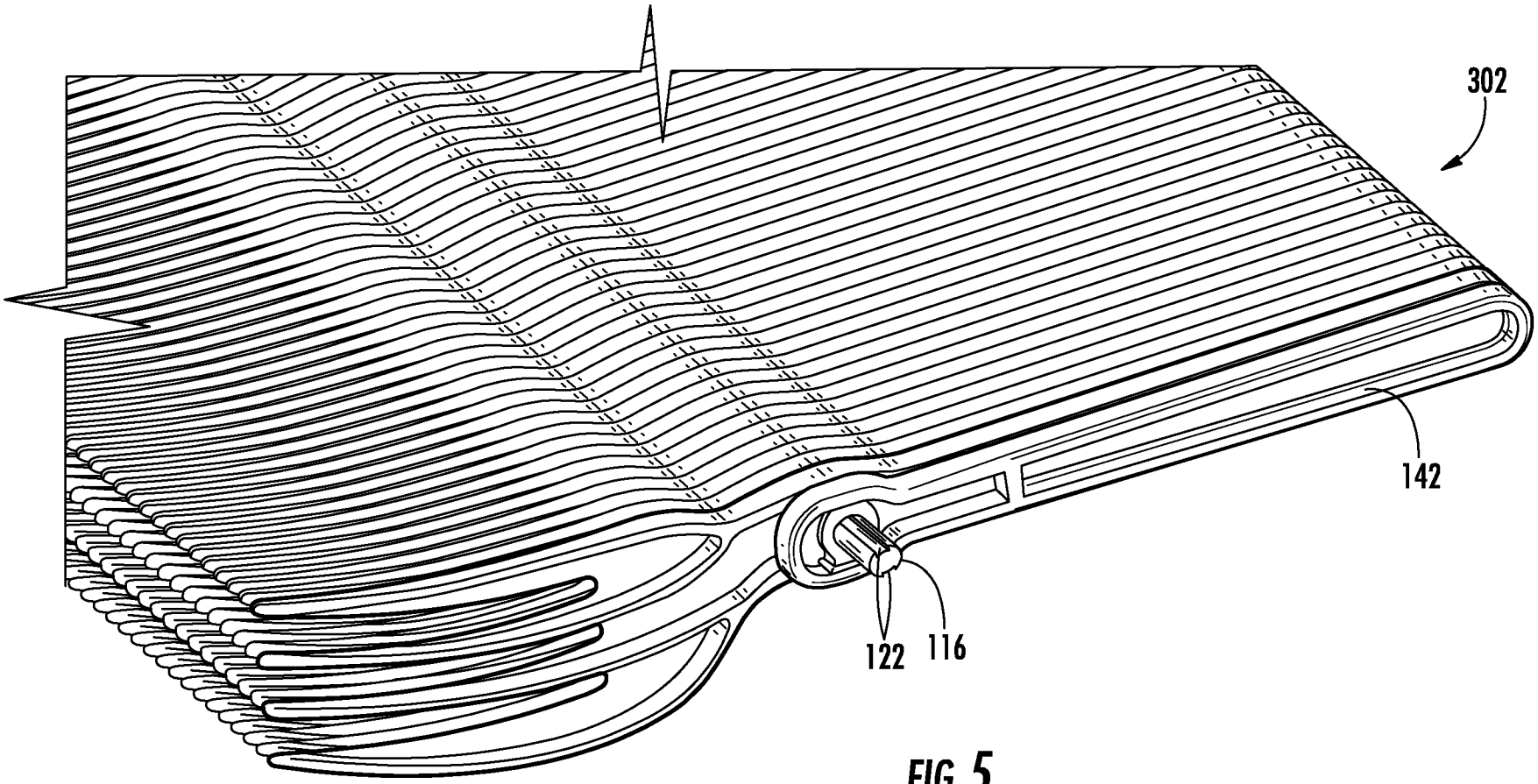
FIG. 5 is an isometric view of an end of the utensil support assembly showing a stack of utensils secured to the skewer by a retainer member embodying aspects of the disclosed subject matter.

Referring to FIGS. 1 and 2, the utensil support assembly 102 includes a skewer 104 for retaining utensils 302 thereon. The skewer 104 has an elongated body 106 extending between a first end 108 and a second end 116. The first end 108 of skewer 104 forms a mount 124. The mount 124 comprises a head 126, and a lower portion forms a neck 130. The head 126 extends upward and outward from the neck 130, with the head 126 forming a lower surface and opposing lips 134 at a top edge. The body 106 has a non-cylindrical cross-section that complements a non-cylindrical opening 312 in the body of the utensils 302 as shown in FIG. 4. In an embodiment, the body 106 has a ridged cross-section, and the openings in the body of the utensils forms an opening that receives the ridged section of the body 106 in a complementary relationship. The second end 116 of the skewer has a cylindrical configuration around which the utensils 302 can freely rotate. While opening 312 may itself have a non-cylindrical configuration, the opening is dimensioned such that it can still rotate around second end 116 of the skewer. A retainer member 142 attaches to the second end 116 of the skewer to retain utensils 302 on the skewer until dispensed. In an embodiment, the second end 116 defines longitudinally disposed, open-ended slots 118 to serve as keyway grooves that receive cog elements 148 that are disposed in opening 312 in retainer member 142. The keyway grooves 118 provide a means by which the cog elements 148 may be guided to permit retainer member 142 to be slidably received along second end 116 of the skewer. The keyway grooves 118 can also be configured to present a means to block the cog elements 148 from moving through the keyway grooves 118 until such movement is desired.

Figure 6:
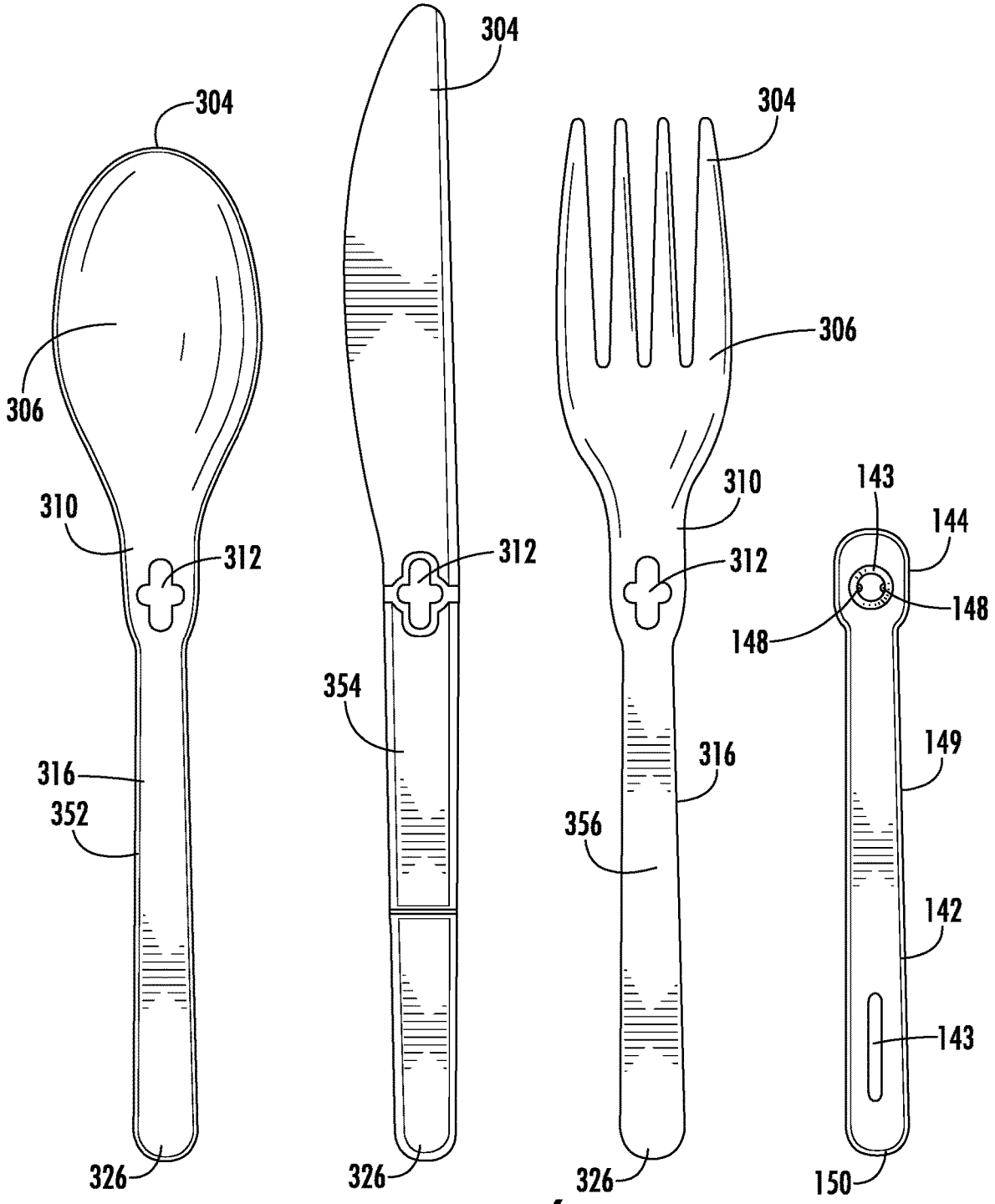
FIG. 6 is a plan view of exemplary utensils and a retainer member embodying aspects of the disclosed subject matter.

Referring to FIG. 6, utensils 302 and the retainer member 142 are further described. In an implementation, the utensils 302 and retainer member 142 are manufactured from plastic. In general, each utensil 302 extends between a first end 304 and a second end 326. The first end 304 forms a head 306 that is used by a user for eating food. A neck 310 is disposed between the head 306 and a body 316. The neck 310 and body 316 are used by a user to hold the utensil 302 for eating. The neck 310 forms the opening 312 that complements the cross section of the skewer body 106. In an implementation, the opening 312 and skewer body 106 are cross-shaped. A spoon 352 is shown with the head 306 forming a bowl extending from the tip to the neck 310. A knife 354 is shown with a cutting edge extending from the tip to the neck 310. A fork 356 is shown with a curved back extending from the neck 310 and forming tines extending from the back to the tip. The retainer member 142 is shown with the body 149 extending between the first end 144 and second end 150. In an implementation, the body 149 of the retainer member 142 has the same general shape as the body 316 of the utensil 302 to allow the retainer member 142 to provide support from below for the stack of utensils 302 on the skewer 104 until the retainer member 142 is removed from the skewer 104. Also, to help provide alignment of the retainer member 142 with the utensils above it, a raised portion 143 may be provided on the top surface of body 149. Correspondingly, a bottom surface of utensils 302 may be provided with a recessed area (not shown) for receiving raised portion 143. In that fashion, retainer member 142 may nestle against the adjacent utensil 302 to preserve alignment until ready for dispensing. In use, the utensil support assembly 102 is loaded with a plurality of utensils 302 and mounted in a dispensing position within the cabinet housing 202 as shown in FIG. 2. The utensils 302 are dispensed from the skewer 104 by an actuator 156 after dislodging the retainer member 142 from the skewer 104.

The cabinet housing 202 includes a front cover 220, an upper chamber 204 and a base 232 as shown in FIG. 2. In an implementation the cabinet housing 202 is formed from plastic. The upper chamber 204 is open towards the bottom. A movable front cover 220 is connected to a wall by hinges 222. The top wall 212 forms a slot 214 allowing the utensil support assembly 102 to be supported at the first end 108 by the top wall 212. The dimensions of the interior of the upper chamber 204 and the utensil support assembly 102 are such that the second end 116 of skewer 104 is positioned at the actuator 156 of base 232 as shown in FIG. 2.

Figure 7:
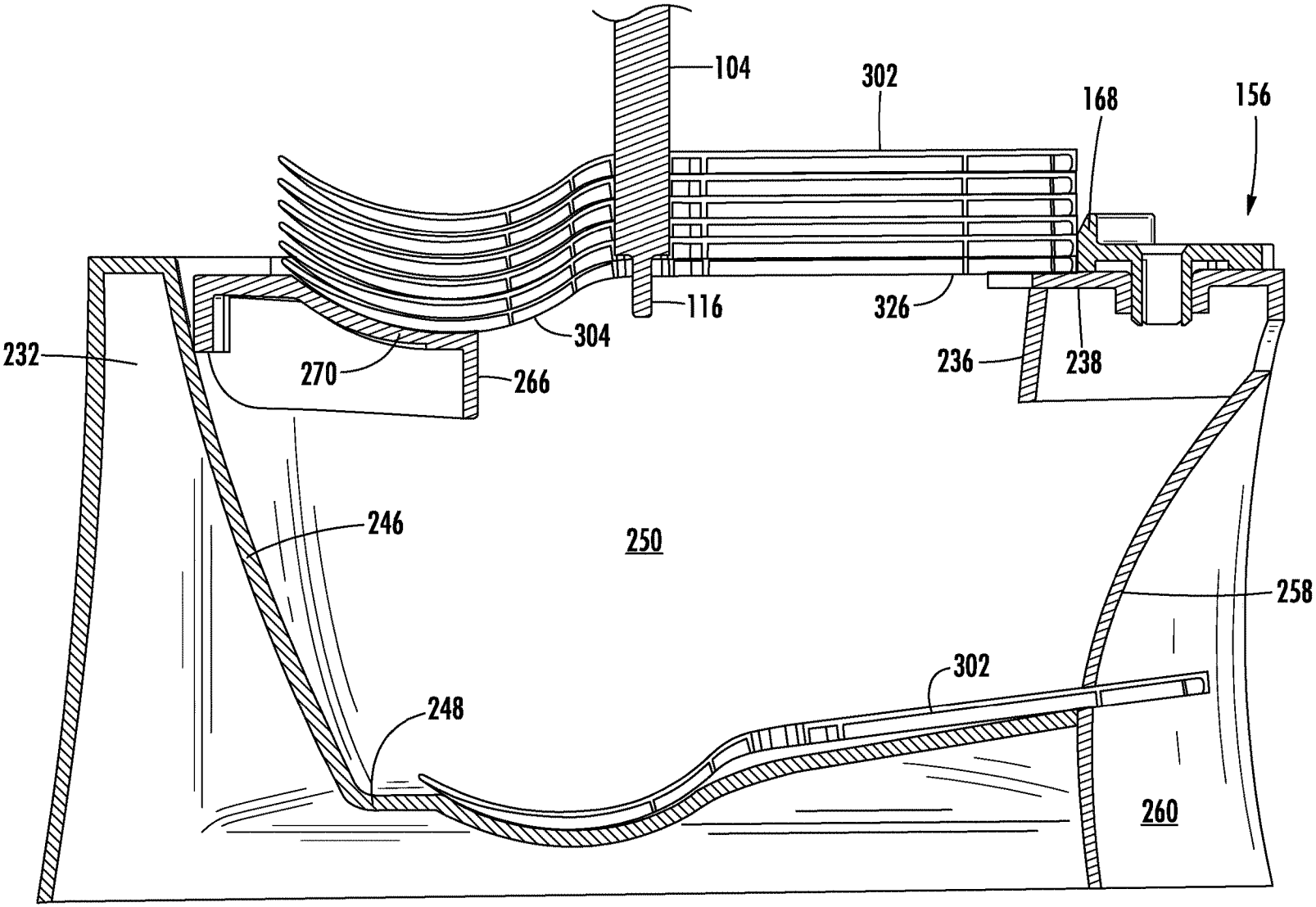
FIG. 7 is a sectional elevation view of a utensil dispenser system embodying aspects of the disclosed subject matter showing the utensil support assembly mounted in the cabinet housing for dispensing utensils.
Figure 8:
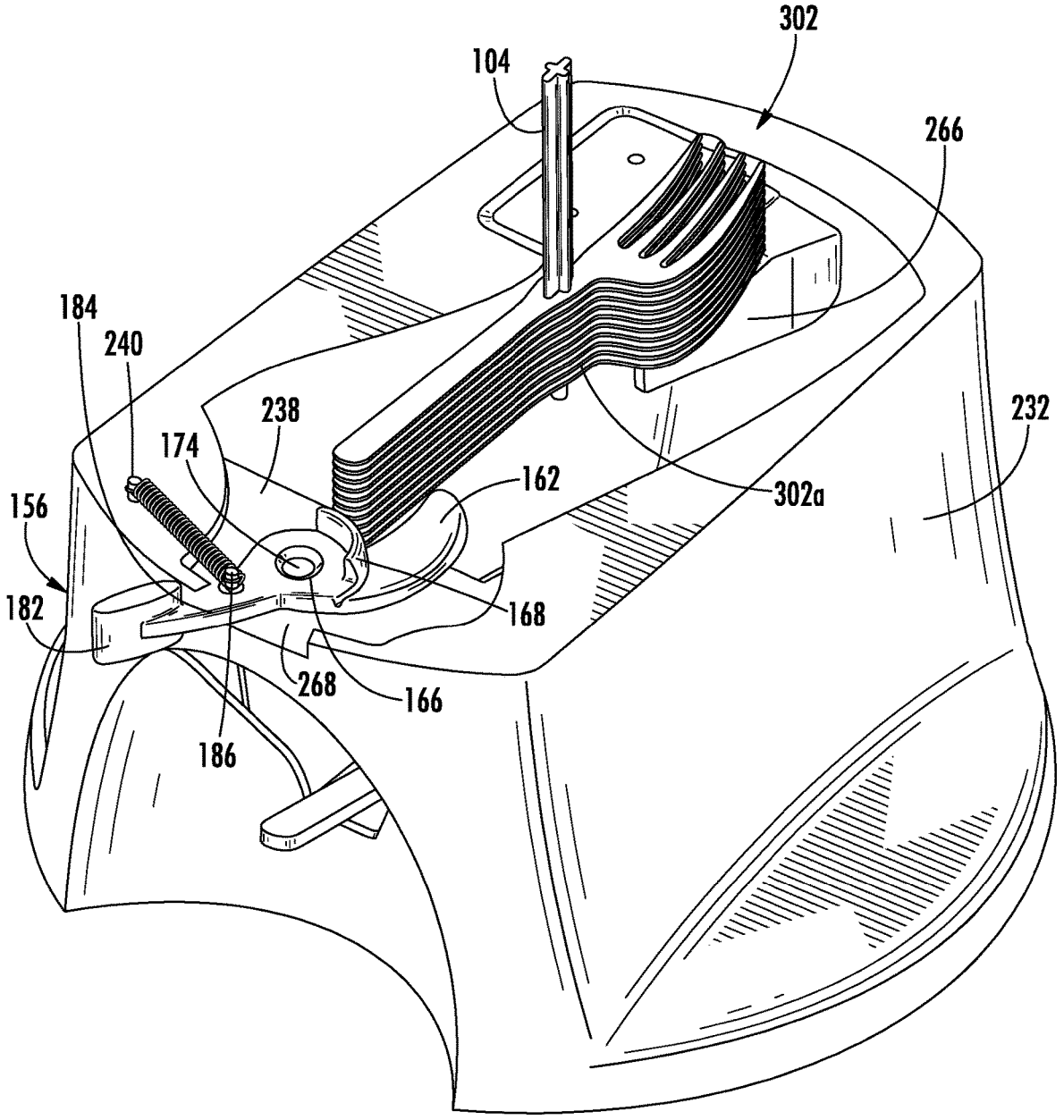
FIG. 8 is an isometric view of a portion of the utensil dispenser system shown in FIG. 7.
Figure 15:
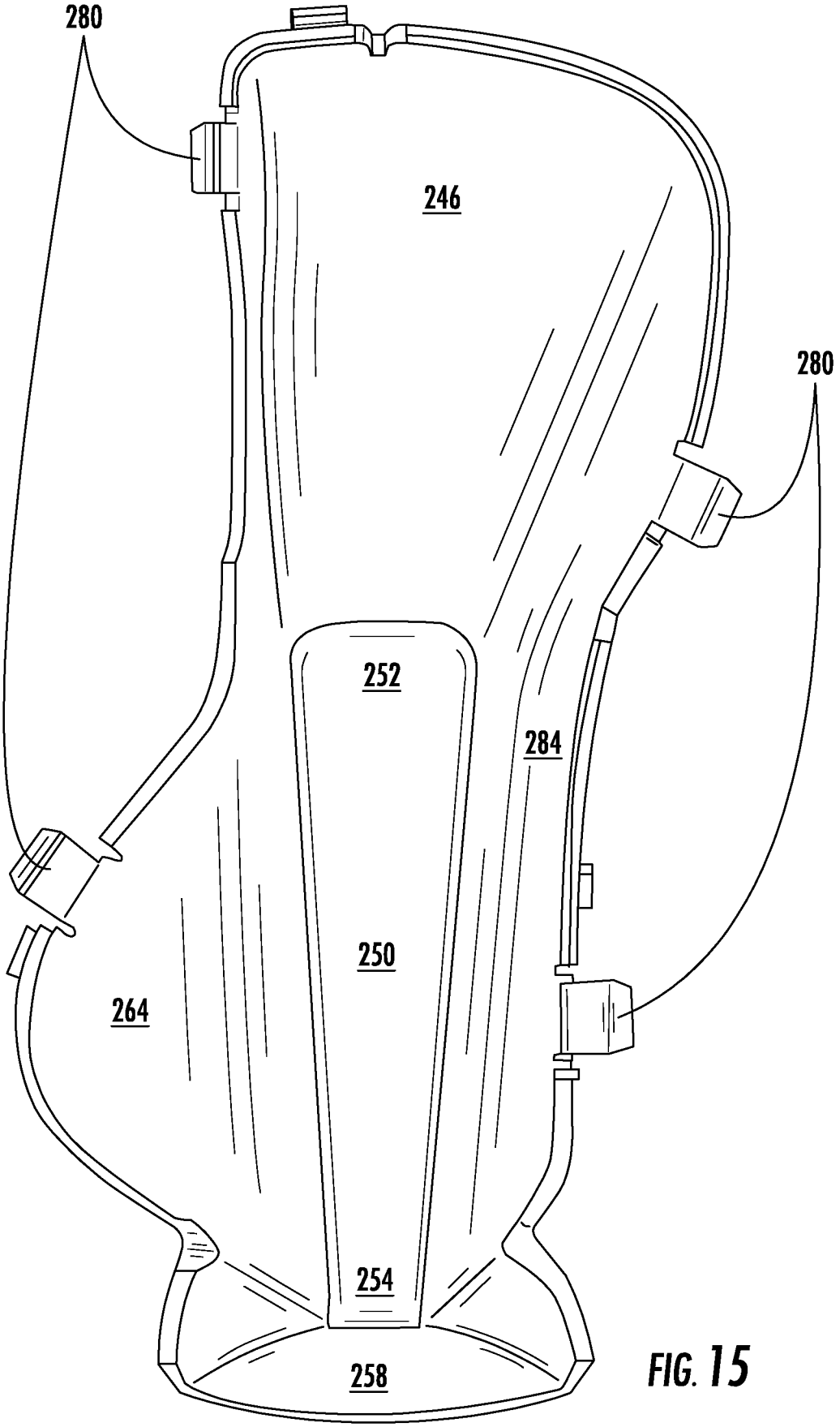
FIG. 15 is an isometric view of the interior of an embodiment of the utensil dispenser system showing the dispensing reservoir.

The base 232 forms a chute 250 below the utensil support assembly 102 for dispensing a utensil 302 from an opening 260 as shown in FIG. 7. The base 232 has a front shelf 236 at a front wall 258 and a rear shelf 266 at a rear wall 246. The front shelf 236 forms a ledge 238 at the interior of the base 232 adjacent the chute 250, and the rear shelf 266 supports a platform 270 at the interior of the chute 250. As shown in FIG. 15, the chute 250 is bound by a first sidewall 264 and a second sidewall 284, and the rear wall 246 and the front wall 258. The first sidewall 264 extends from the rear shelf 266 toward the front wall 258, tapering at the top from a wide top wall to a narrow bottom wall. The first sidewall 264 slopes downward toward the middle of the base 232 merging into the chute 250. A first end 252 of the chute 250 is adjacent the rear wall 246, and the second end 254 of the chute 250 is adjacent the front wall 258. As seen in FIG. 7, a bottom wall 248 of the chute 250 extends from the rear wall 246 toward the opening 260, sloping downward from the rear wall 246 toward the bottom of the base 232 then extending upward toward the opening 260. Utensils 302 positioned at the second end 116 of the skewer 104 are supported by the ledge 238 and rear shelf 266.

The first end 304 of the utensil 302 is supported by the rear shelf 266, and the second end 326 of the utensil 302 is supported by the ledge 238. In an implementation, the rear shelf 266 conforms to the bowl shape of the spoon 352 or the neck and tines of the fork 356. The utensil 302 is supported by the ledge 238 and rear shelf 266 until the actuator 156 is used to dispense the utensil. Upon operation of the actuator 156, the utensil 302 is rotated in a clockwise direction about the second end 116 of skewer 104, moving the first end 304 off of the platform 270 and the second end 326 off of the ledge 238. The utensil then drops off of skewer end 116 and falls by gravity down chute 250 where it is guided by sidewall 264 to present end 326 of utensil 302 in opening 260.

The actuator 156 is pivotally mounted to the base 232 adjacent and above the ledge 238 as shown in FIGS. 7-11. In an embodiment, the actuator 156 is manufactured from plastic. The actuator 156 includes central body 166 having a first end 158 forming an engagement face 160 and top surface 162, and a second end 182 forming a lever arm 184 and spring mount 186. A second spring mount 240 is positioned on base 232. A coil spring 190 connects the spring mount 186 to second spring mount 240. The central body 166 forms a crescent-shaped end wall 168 concentric with a support shaft 174. The end wall 168 contacts the second end 150 of the retainer member 142, and the second end 326 of the utensil 302 as the utensils move vertically downward along the skewer 104 maintaining alignment of the bottom of the utensil support assembly 102 within the cabinet 204. The second end 182 of actuator 156 extends through a notch 268 in base 232 for access by a user.

Figure 3:
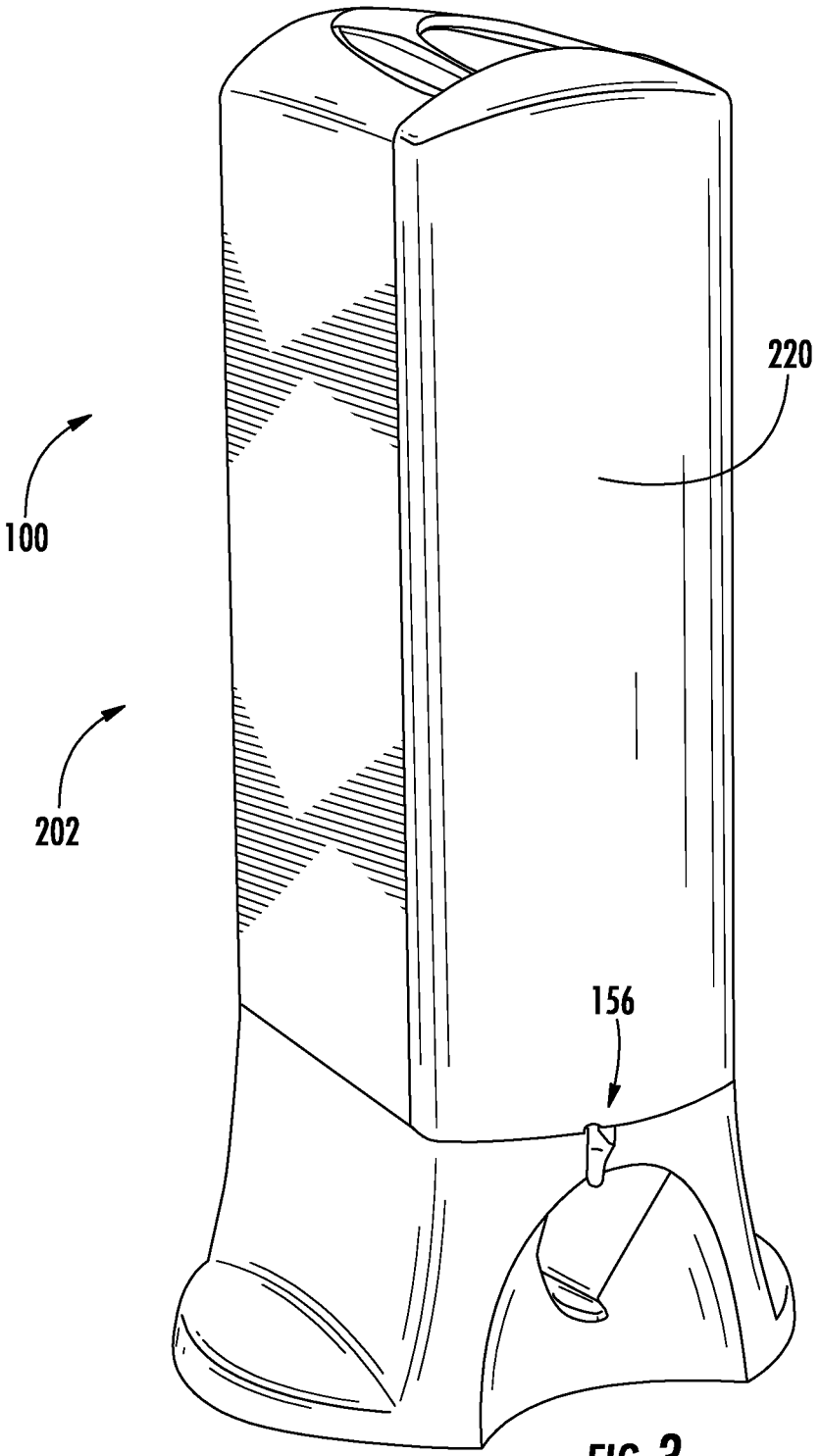
FIG. 3 is an isometric view of the utensil dispenser of FIG. 1 showing the front cover closed and the cabinet housing enclosing the utensil support assembly.

In use, a utensil support assembly 102 is loaded with a stack of utensils 302 by sliding a plurality of utensils 302 onto skewer end 116 through their openings 312 along skewer body 106. The complementary alignment of the openings 312 with the non-cylindrical cross-section of skewer body 106 allows longitudinal movement of the utensils along the skewer while prohibiting their rotation to help keep alignment of the utensils in the stack. The retainer member 142 is secured to the skewer end 116 to retain the utensils on the skewer until the utensil support assembly 102 is loaded into place in cabinet housing 202. Utensil support assembly 102 is positioned within cabinet housing 202 by aligning the head 126 of the mount 124 with the slot 214 in the cabinet 204 (FIGS. 1-2). The angular formations of the head 126 and slot 214 are complementary allowing the two features to nest together. Upon loading the utensil support assembly 102 into the cabinet the second end 150 of the retainer member 142 rests on the ledge 238. This alignment also positions the first ends 304 of the utensils 302 over the rear shelf 266 and the second ends 326 of the utensils 302 over the ledge 238 as shown in FIG. 7. The length of skewer 104 should be made so that cylindrical second end 116 lies above ledge 238 to permit rotation of the utensils in the dispensing action. As utensils are sequentially dispensed, the next utensil drops down along the skewer such that its ends 304 and 326 come to rest on rear shelf 266 and ledge 238 respectively to await dispensing. The front cover 220 is moved to a closed position sealing the cabinet 204 (FIG. 3).

Figure 9:
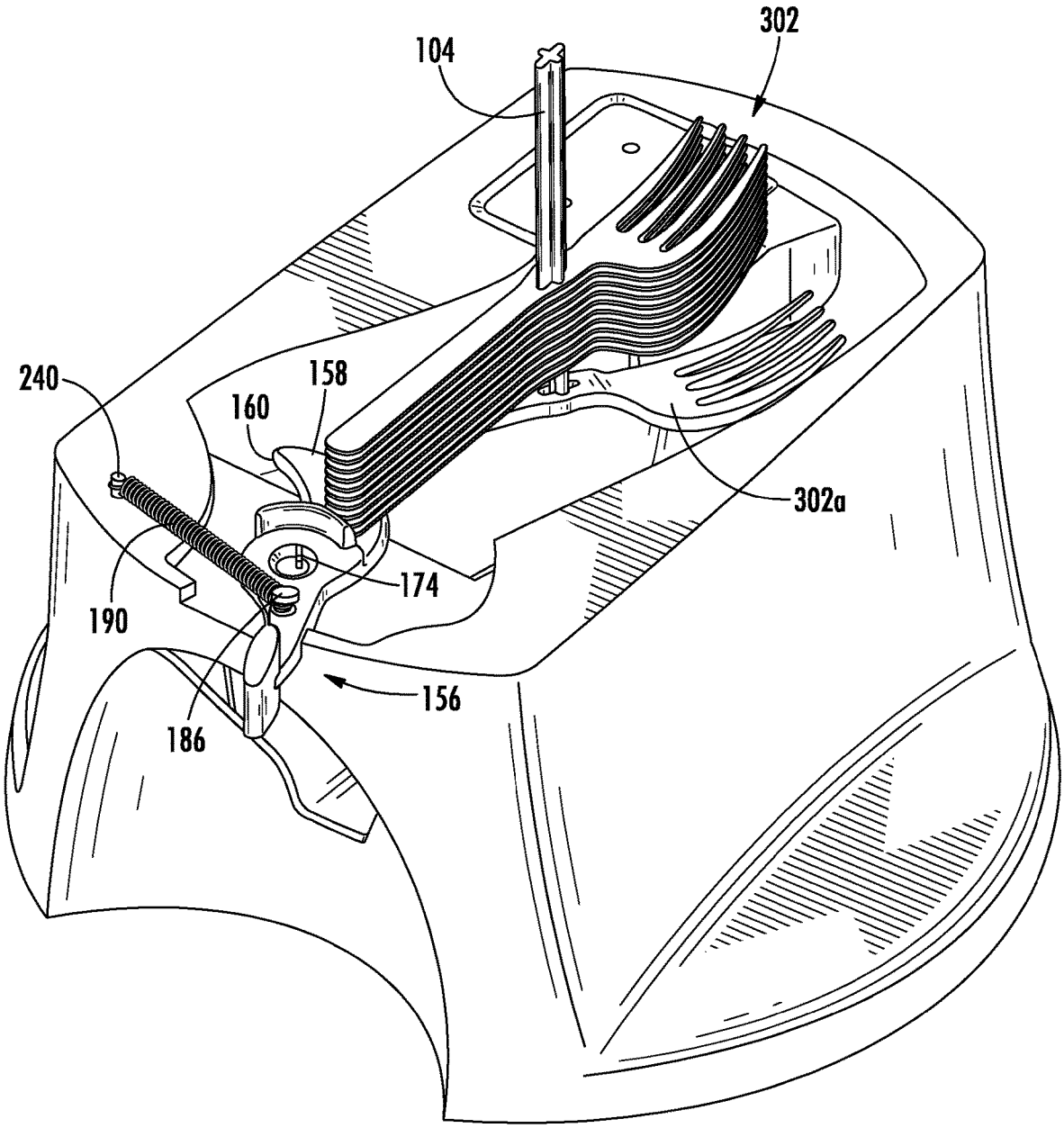
FIG. 9 is an isometric view of the utensil dispenser system similar to FIG. 8.
Figure 10:
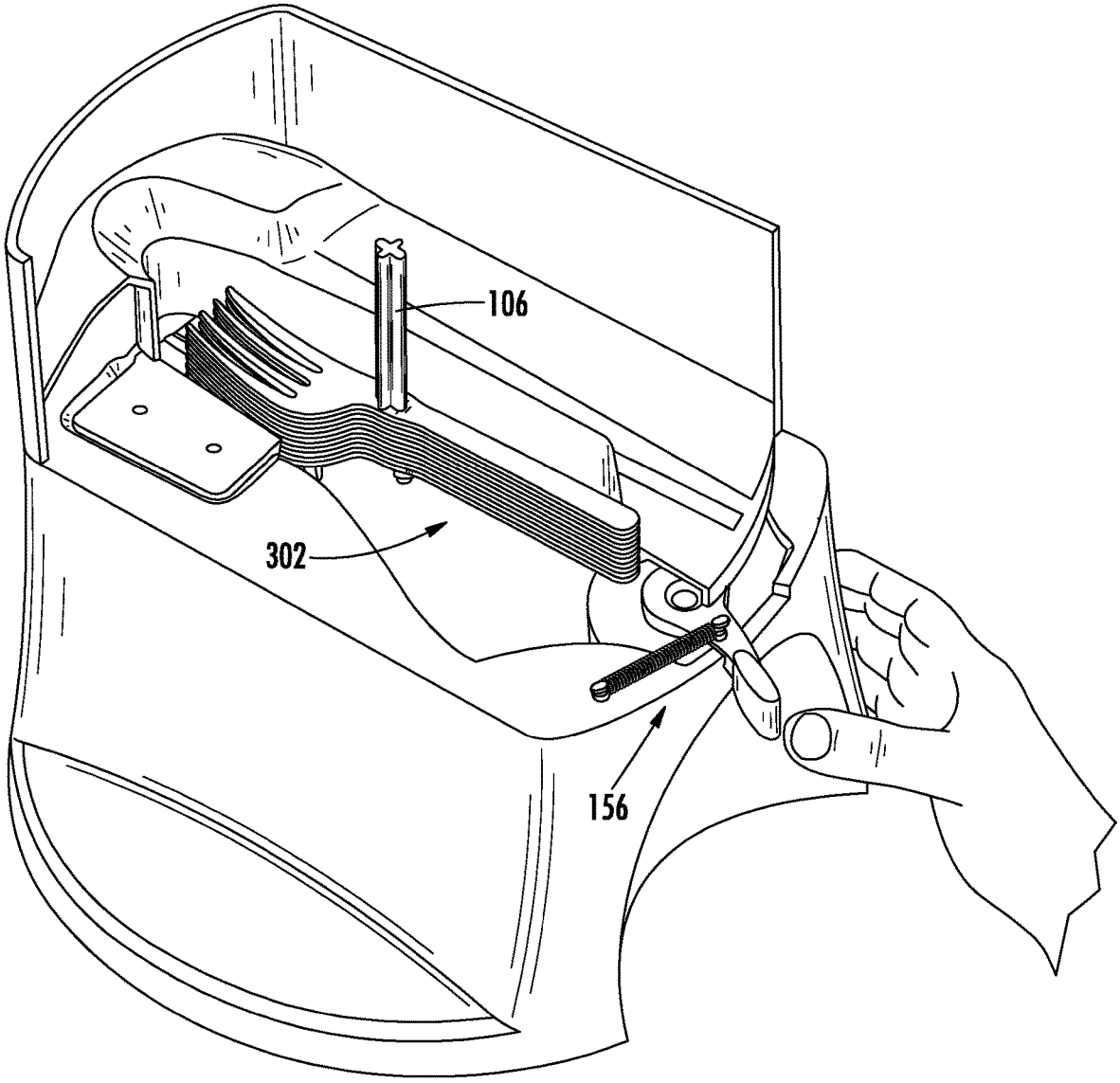
FIG. 10 is an alternative isometric view of the utensil dispenser system showing the actuator.
Figure 11:
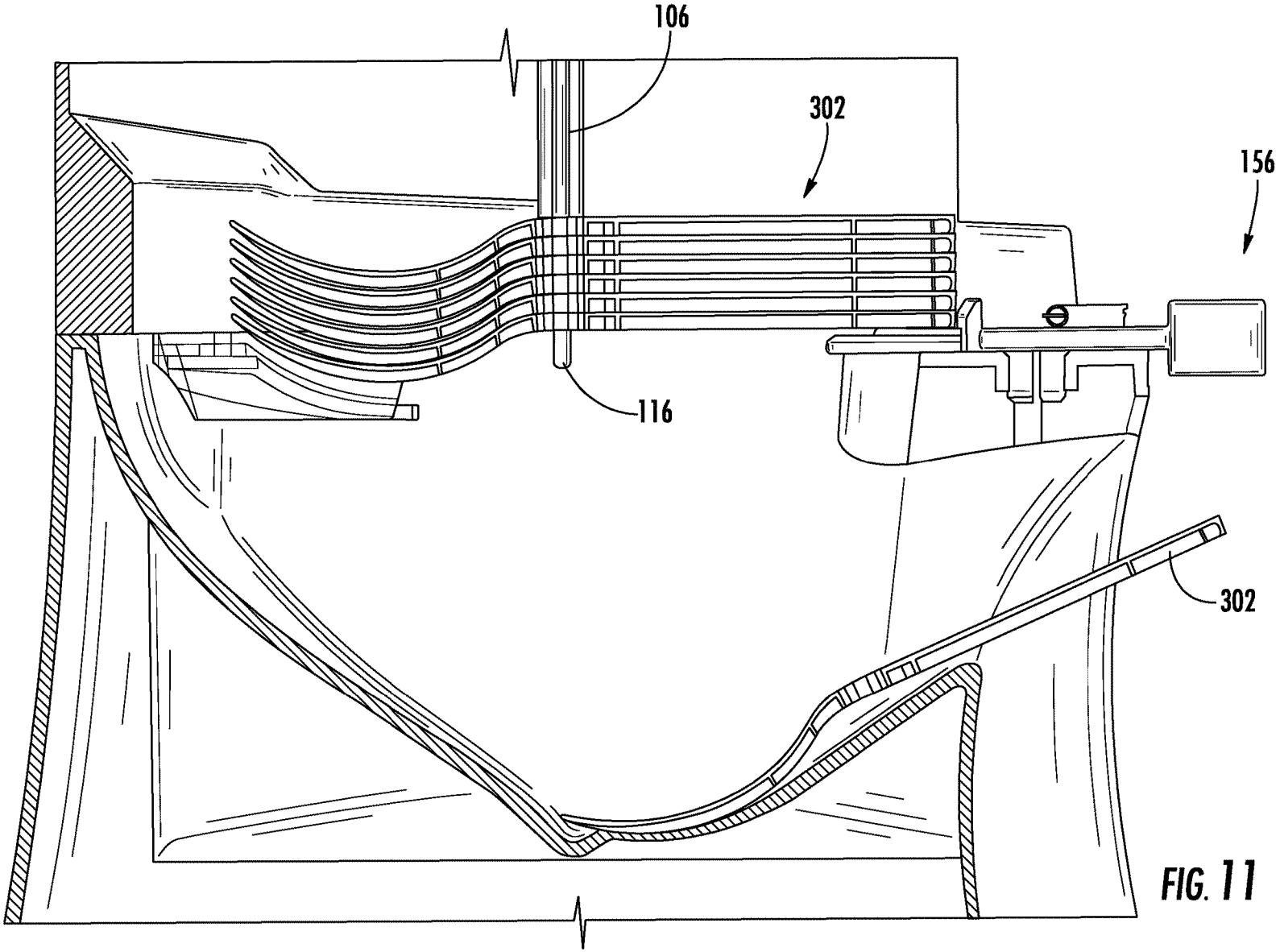
FIG. 11 is a sectional elevation view of the utensil dispenser system showing a dispensed utensil extending from the opening in the base.

The retainer member 142 is removed from the skewer 104 before any utensils 302 are dispensed from the dispenser system 100. The actuator 156 has a rest position (shown in FIG. 8) where the engagement face 160 of the actuator 156 is adjacent to the side edge of a first utensil 302*a* ready for dispensing. Movement of the actuator 156 from the rest position to a dispensing position is effected when the second end 182 is moved to the right, causing the body 166 of the actuator to rotate about support shaft 174. Through this movement, the engagement face 160 pushes against the edge of the utensil 302*a* causing it to rotate about the cylindrical end 116 of skewer 104 as shown in FIG. 9. In clockwise movement, end 304 of utensil 302*a* pivots off of rear shelf 266 and end 326 pivots off of ledge 238 whereby utensil 302*a* falls off of skewer 104 by gravity and drops down into chute 250. The slope of the walls of chute 250 promotes the orientation of the utensil for presentation of end 326 to the user through opening 260 in the front of the unit. This permits a user to grasp only the end of the dispensed utensil thereby minimizing the user's contact with other non-dispensed utensils and minimizing contamination during retrieval of the utensil.

The top surface 162 of the actuator 156 passes beneath the end 326 of the next ready utensil 302 located immediately above utensil 302*a* to restrict the next ready utensil from dropping down onto the cylindrical end 116 of skewer 104 during the dispensing of utensil 302*a*. Furthermore, the next ready utensil 302 does not rotate from its position because its opening 312 remains aligned with the non-cylindrical portion 106 of skewer 104. Upon moving the actuator 156 to dispense ready utensil 302*a*, first end 158 of actuator 156 supports the stack of utensils 302 at their second end 326 as shown in FIG. 9. After utensil 302*a* is dislodged from the skewer 104 the actuator 156 is released and the tension in the spring 190 moves first end 158 of actuator 156 back to its original rest position. During this return process the top surface 162 withdraws from beneath end 326 of the next ready utensil 302, and as the top surface 162 clears from below the stack of utensils 302 they move downward along the skewer 104. The downward movement of the stack is arrested when the head 306 of the next ready utensil 302 contacts rear shelf 266, and the utensil end 326 contacts the ledge 238 as shown in FIG. 7. Thereupon, the next ready utensil is ready for dispensing. In this fashion, the utensils can be sequentially dispensed by repeated operation of the actuator until the stack of utensils in utensil support assembly 102 is depleted. The empty utensil support assembly can then be removed from cabinet housing 202 and a newly filled utensil support assembly can be installed in the cabinet housing as described above.

Figure 12:
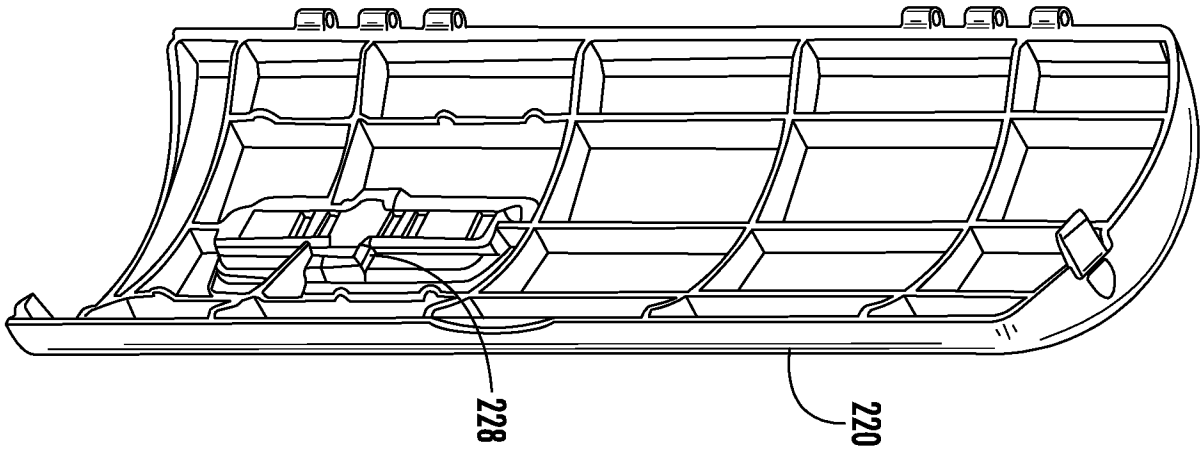
FIG. 12 is an isometric view of the interior of the front door of the cabinet housing.

Referring to FIG. 12, an embodiment of the utensil dispenser system 100 includes a signage mounting configuration 228 in the front cover 220. The signage mounting configuration can comprise a badge for receiving an image or text, with a pair of tabs that can be received within spaced apertures inside the interior surface of front cover 220. An opening is provided in front cover 220 so that the badge is viewable from the outside of the housing. The signage mounting configuration may therefore display to the user a representation of the utensil 302 currently being dispensed to a user, for example, a spoon 352, a knife 354, or a fork 356. An embodiment of the utensil dispenser system 100 may include a handle (not shown) pivotally connected to the top of the cabinet 204 allowing a user to lift the utensil dispenser system 100 and move the assembly. In an embodiment, the upper chamber 204 is removable from the base 232 to permit cleaning of the elements. Upper chamber 204 is inserted onto base 232 and secured in place by depressible tabs 280 at an upper edge of base 232 interlocking with complimentary receivers in openings at a bottom edge of upper chamber 204 as shown in FIG. 15.

Figure 13:
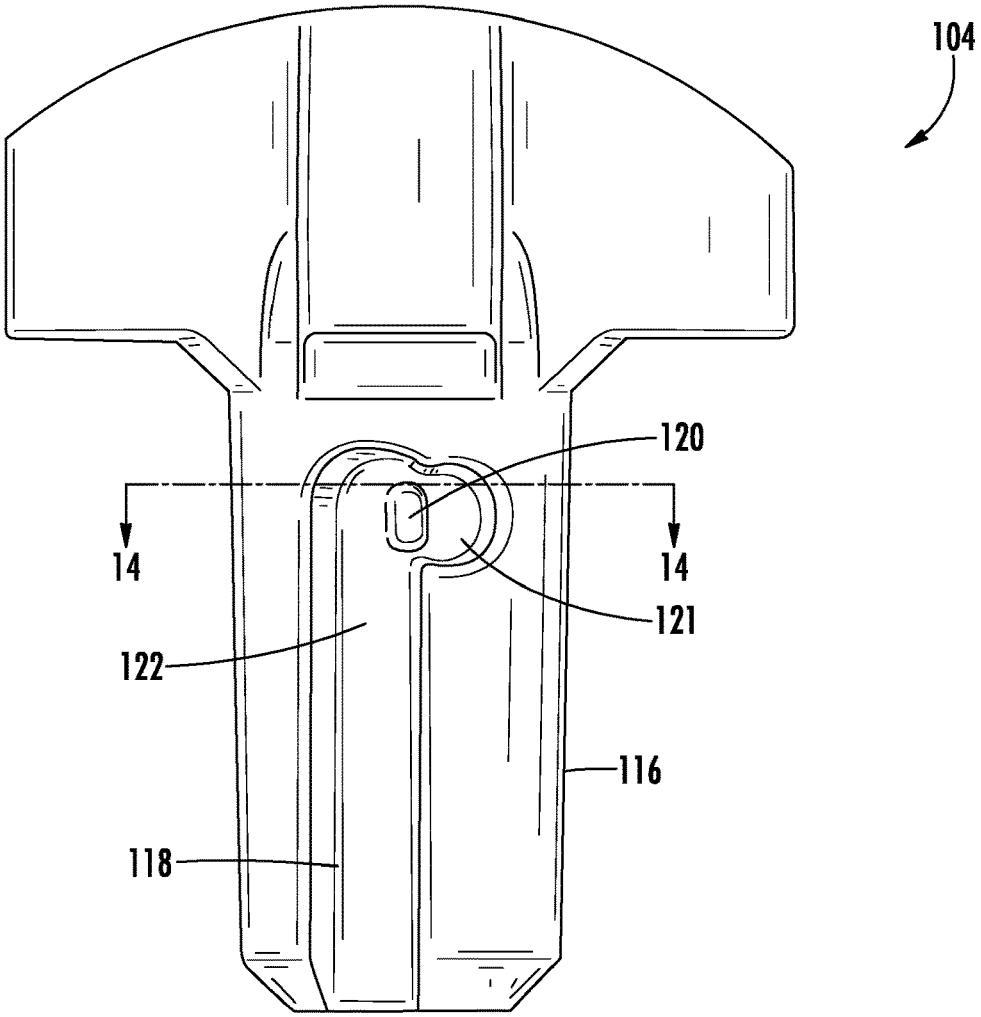
FIG. 13 is a view in side elevation of the bottom end of the skewer of the utensil support assembly.
Figure 14:
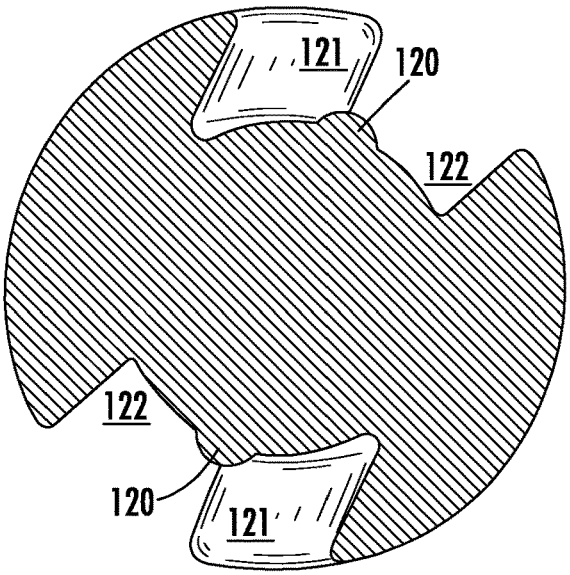
FIG. 14 is a cross-sectional view taken along lines 14-14 in FIG. 13.
Figure 16:
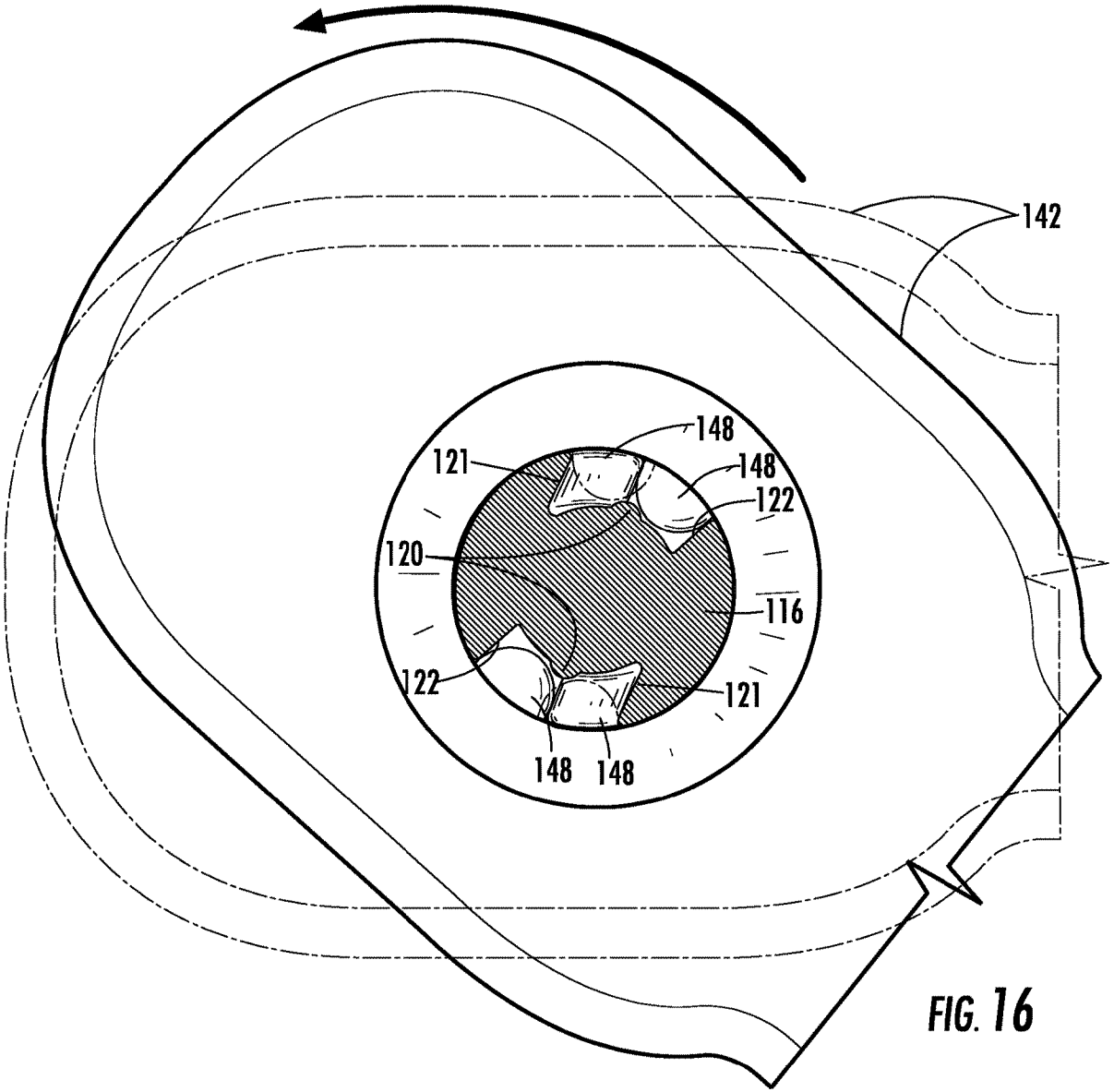
FIG. 16 is a cross-sectional view similar to FIG. 14 showing the relationship between the keyway in the bottom end of the skewer and the retainer member.

Referring to FIGS. 13-14 and 16, an embodiment of the utensil support assembly provides an arrangement for securing retainer member 142 on skewer 104 until the utensils are ready for dispensing. The retainer member 142 can be mounted to the second end 116 to retain utensils 302 on the skewer 104 when the loaded skewer 104 is transported prior to use. The second end 116 of skewer 104 defines at least one L-shaped slot 118 which acts as a keyway for cog element 148 in opening 312 of retainer member 142. Slot 118 is open at the terminal end of skewer end 116. A slot 118 may be provided on opposing sides of skewer end 116, and opening 312 of retainer member 142 may have a pair of cog elements 148 spaced in complementary fashion to the slots. A bump 120 is disposed in slot 118 separating a first horizontal slot region 121 from a second vertical slot region 122, where the first slot region 121 is adjacent the second slot region 122. Bump 120 acts as a detent to resist passage of the cog element 148 whereby retainer member 142 is inhibited from premature rotational movement about skewer end 116. In an embodiment, the retainer member 142 is formed as a usable utensil 302. In use, retainer member 142 is placed on the end of skewer 104 after the utensils 302 are loaded. The opening 312 of retainer member 142 is placed over skewer end 116 such that cog elements 148 are aligned with vertical slot 122. Retainer member 142 is then slided vertically upward along skewer end 116 to press against the bottom edge of the stack of utensils 302. Retainer member 142 is then rotated such that cog elements slide horizontally into horizontal slots 121. As shown in FIG. 16, vertical slots 122 and horizontal slots 121 are oriented along the skewer end 116 such that body of retainer member 142 is held in alignment with the bodies of the utensils 302 when the cog elements 148 are moved into horizontal slots 121. Bumps 120 inhibit the passage of cog elements 148 to prevent inadvertent rotation of retainer member 142 prior to dispensing. In the dispensing operation described above, actuator 156 engages retainer member 142 to rotate it about skewer end 116 whereby cog elements 148 are moved out of horizontal slots 121 and pass over bumps 120. When cog elements 148 pass into vertical slots 122, retainer member 142 falls by gravity in the same manner as the utensils 302 as shown in FIGS. 7-11.

As required, detailed aspects of the disclosed subject matter are disclosed herein; however, it is to be understood that the disclosed aspects are merely exemplary of the disclosed subject matter, which may be embodied in various forms. Therefore, specific structural and functional details disclosed herein are not to be interpreted as limiting, but merely as a basis for the claims and as a representative basis for teaching one skilled in the art how to variously employ the disclosed technology in virtually any appropriately detailed structure.

Certain terminology will be used in the following description, and are shown in the drawings, and will not be limiting. For example, up, down, front, back, right and left refer to the disclosed subject matter as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning. It is to be understood that while certain aspects of the disclosed subject matter have been shown and described, the disclosed subject matter is not limited thereto and encompasses various other embodiments and aspects.

Although the invention has been disclosed with reference to various particular embodiments, it is understood that equivalents may be employed and substitutions made herein without departing from the scope of the invention as recited in the claims.

Having thus described the preferred embodiment of the invention, what is claimed as new and desired to be protected by Letters Patent includes the following:

1. A utensil dispenser comprising:

a cabinet housing;

a utensil support assembly comprising a skewer for receiving a plurality of utensils, the skewer having a first portion of its body configured to prevent rotation of the utensils about an axis of the skewer and a second portion of its body configured to permit rotation of the utensils about the axis of the skewer;

a utensil actuator for sequentially ejecting utensils from the skewer by rotating the utensils to a position for release from the skewer;

the cabinet housing configured to receive the utensil support assembly for positioning the plurality of utensils above the utensil actuator whereby the utensils are positioned for sequential dispensing;

the cabinet housing further comprising a dispensing reservoir whereby dispensed utensils are deposited.

2. The utensil dispenser of claim 1 in which the cabinet housing defines a chute for guiding dispensed utensils to the dispensing reservoir, the chute having walls that orient a position of the dispensed utensil to present a handle end of the utensil in the dispensing reservoir towards the user for withdrawal from the cabinet housing.

3. The utensil dispenser of claim 1 in which each utensil defines an aperture in a portion of its body for receiving the skewer, the aperture having a complementary configuration to that of the first portion of the body of the skewer to permit longitudinal movement of the utensil along the skewer, the aperture further having a configuration to permit both longitudinal and rotational movement about the axis of the second portion of the body of the skewer, whereby a utensil is dispensed from the skewer upon movement of the utensil past the second end of the skewer.

4. The utensil dispenser of claim 1 in which a retainer member is provided for retaining the utensils on the skewer prior to the dispensing of the utensils.

5. The utensil dispenser of claim 4 in which the second portion of the skewer defines a keyway groove, the retainer member defining an opening in a portion of its body for receiving the second portion of the body of the skewer to permit both longitudinal and rotational movement about the axis of the second portion of the body of the skewer, the retainer member opening having a cog element for engaging the keyway groove in the skewer, whereby the retaining member is restricted from release from the skewer while the cog element is engaged with the keyway groove.

6. The utensil dispenser of claim 1 in which the cabinet housing provides a front shelf and rear pedestal on which the plurality of utensils are supported within the cabinet housing prior to being dispensed.

7. The utensil dispenser of claim 6 in which the utensil actuator is positioned to engage a ready utensil placed in a deployment position at a bottom end of the skewer within the second portion of the skewer body whereby activation of the utensil actuator causes the ready utensil to be rotated about the axis of the skewer and be displaced from the front shelf and rear pedestal whereby the ready utensil falls by gravity from the skewer to the dispensing reservoir.

8. The utensil dispenser of claim 7 in which a next ready utensil moves into the deployment position on the skewer and on the front shelf and rear pedestal upon removal by the utensil actuator of the preceding ready utensil from the skewer.

9. The utensil dispenser of claim 8 in which the utensil actuator restricts the next ready utensil from removal from the skewer while the ready utensil is rotated.

10. The utensil dispenser of claim 9 in which the utensil actuator comprises a cam arm operatively connected to a trigger member positioned externally of the cabinet housing for operation by a user.

11. The utensil dispenser of claim 10 in which the cam arm is spring loaded for retracting the cam arm back to an initial position to permit advancement of the next ready utensil into the deployment position.

12. A utensil support assembly for receiving a plurality of utensils for dispensing from a utensil dispenser, the utensil support assembly comprising:

a skewer for receiving the utensils, the skewer having a first portion of its body configured to prevent rotation of the utensils about an axis of the skewer and a second portion of its body configured to permit rotation of the utensils about the axis of the skewer;

a plurality of utensils, each utensil defining an aperture in a portion of its body for receiving the skewer, the aperture having a complementary configuration to that of the first portion of the body of the skewer to permit longitudinal movement of the utensil along the skewer, the aperture further having a configuration to permit both longitudinal and rotational movement about the axis of the second portion of the body of the skewer, whereby a utensil is dispensed from the skewer upon movement of the utensil past the second end of the skewer.

13. The utensil support assembly of claim 12 in which an exterior surface of the first portion of the skewer body comprises at least one projection and the aperture in the utensil defines at least one channel having a dimension to receive the at least one projection of the skewer body, and the second portion of the skewer body is cylindrical.

14. The utensil support assembly of claim 13 in which a retainer member is provided for retaining the utensils on the skewer prior to the dispensing of the utensils.

15. A utensil support assembly for receiving a plurality of utensils for dispensing from a utensil dispenser, the utensil support assembly comprising:

a skewer for receiving the utensils, the skewer having a first portion of its body configured to prevent rotation of the utensils about an axis of the skewer and a second portion of its body configured to permit rotation of the utensils about the axis of the skewer, the second portion of the skewer defining a keyway groove;

a plurality of utensils, each utensil defining an aperture in a portion of its body for receiving the skewer, the aperture having a complementary configuration to that of the first portion of the body of the skewer to permit longitudinal movement of the utensil along the skewer, the aperture further having a configuration to permit both longitudinal and rotational movement about the axis of the second portion of the body of the skewer, whereby a utensil is dispensed from the skewer upon movement of the utensil past the second end of the skewer;

a retainer member for retaining the utensils on the skewer prior to the dispensing of the utensils, the retainer member defining an opening in a portion of its body for receiving the second portion of the body of the skewer to permit both longitudinal and rotational movement about the axis of the second portion of the body of the skewer, the retainer member opening having a cog element for engaging the keyway groove in the skewer, whereby the retaining member is restricted from release from the skewer while the cog element is engaged with the keyway groove.

16. The utensil support assembly of claim 15 in which an exterior surface of the first portion of the skewer body comprises at least one projection and the aperture in the utensil defines at least one channel having a dimension to receive the at least one projection of the skewer body, and the second portion of the skewer body is cylindrical.

17. The utensil support assembly of claim 15 in which a first portion of the keyway groove lies transversely to the axis of the skewer and a second portion of the keyway groove lies parallel with the axis of the skewer, whereby the retaining member is restricted from release from the skewer while the cog element in the retaining member opening engages the first portion of the keyway groove, and is adapted for release from the skewer when the cog element engages the second portion of the keyway groove.

18. The utensil support assembly of claim 17 in which a detent member is provided in the first portion of the keyway groove to impede unintended rotational movement of the retainer member.

* * * * *